US005864290A

United States Patent [19]

Toyomi et al.

[11] Patent Number: 5,864,290

[45] Date of Patent: Jan. 26, 1999

[54] MAGNETIC ALARM TAG RELEASING DEVICE FOR A THEFT MONITORING DEVICE

[75] Inventors: Toshitaka Toyomi; Hideki Arimoto; Hideki Miyake; Seisi Namioka; Shin Kinouchi; Nobuyuki Ichimiya; Daisuke Takai, all of Tokyo, Japan

[73] Assignees: Secom Co., Ltd.; Alps Electric Co., Ltd., both of Tokyo, Japan

[21] Appl. No.: 852,346

[22] Filed: May 7, 1997

[30] Foreign Application Priority Data

May 16, 1996 [JP] Japan ..... 8-121656

[51] Int. Cl.[6] ..... G08B 13/22

[52] U.S. Cl. ..... 340/572; 70/57.1; 324/149; 340/571; 340/636; 340/693

[58] Field of Search ..... 340/572, 571, 340/551, 693, 636; 70/57.1; 324/149; 220/230

[56] References Cited

U.S. PATENT DOCUMENTS 4,573,042 2/1986 Boyd et al. ..... 340/572.9
5,068,641 11/1991 Esch ..... 340/572.9
5,079,540 1/1992 Narlow et al. ..... 340/572
5,589,819 12/1996 Takeda ..... 340/572

FOREIGN PATENT DOCUMENTS

WO90/09648 8/1990 WIPO .
WO92/22045 12/1992 WIPO .

*Primary Examiner*—Glen Swann
*Attorney, Agent, or Firm*—Nikaido, Marmelstein, Murray & Oram LLP

[57] ABSTRACT

An alarm tag releasing device is provided for a theft monitoring device. The theft monitoring device has a gate installed in a desired position and producing a theft monitoring region of a predetermined range by transmitting radio waves at a predetermined wavelength. A buzzer tag is attached to a protected item by a built-in lock mechanism so as not to be detached, and an alarm circuit operated by a built-in battery to sound an alarm when the radio waves at the predetermined wavelength are received when the buzzer tags enters the monitoring region, said alarm tag releasing device comprising: an insertion part having a shape corresponding to the outer diameter of the buzzer tag and into which the buzzer tag can be inserted, such that the lock mechanism provided in the buzzer tag is unlocked when the buzzer tag is inserted into the insertion part.

5 Claims, 6 Drawing Sheets

MAGNETIC ALARM TAG RELEASING DEVICE FOR A THEFT MONITORING DEVICE

BACKGROUND OF THE INVENTION

The present invention relates to a theft monitoring device for preventing shoplifting of merchandise and commodities, and an alarm tag releasing device which is used for the theft monitoring device, detaches an alarm tag attached to a commodity from the merchandise or commodity, and cancels a function of monitoring a monitored device.

A theft monitoring device is provided for monitoring commodities so as not to be illegally removed or stolen from a particular establishment. The theft monitoring device is constructed, for example, in such a manner that a monitoring device body (gate unit) having a transmitter is installed at the doorway of a shop and a monitored device (buzzer tag) is attached to a commodity to be monitored.

The buzzer tag has a receiving antenna for receiving radio waves from the transmitter of the gate unit, a receiver, an alarm device, and related components.

The gate unit monitors around the doorway as a monitoring region by transmitting radio waves from the transmitter at a predetermined frequency (for example, 32 kHz).

When a commodity with the buzzer tag is carried through the gate unit, the buzzer tag receives the radio waves from the gate unit and sounds an alarm from the alarm device.

When the buzzer tag is further provided with a transmitter and a transmitting antenna and the gate unit is provided with a receiver and a receiving antenna, so that if the commodity is carried through the gate unit, both of the buzzer tag and the gate unit sound alarms, thereby enhancing the theft preventing effect.

The buzzer tag is detached from the commodity by using a specific releasing device at a register when payment for the commodity is made.

However, since the buzzer tag can sound an alarm by being driven by a built-in battery, the alarm may not sound if the battery condition is deteriorated; as a result, the crime preventing effect deteriorates.

Although the buzzer tag itself consumes a very small amount of electricity, since the battery is used over long periods of time, it is necessary to change the battery every predetermined period. However, when it is constructed so that the state of the battery voltage can easily be detected by seeing the buzzer tag itself, the crime preventing effect cannot be obtained. Buzzer tags with low battery voltage indications would become targets for theft.

Due to this, the battery voltage of a conventional buzzer tag cannot be easily confirmed even by a person in charge of the theft monitoring device (manager of the register or the like).

Especially, when there are a plurality of such buzzer tags attached to respective commodities, it cannot be discriminated which buzzer tag has a consumed battery in appearance, so that the battery is not often changed even though it may be necessary.

As mentioned above, although the person in charge has to check the battery voltage of the buzzer tag, there is no means by which the time of the battery change can be easily known. Consequently, solving means by which the battery change time can be properly confirmed is strongly desired.

The buzzer tag has to be constructed so as not to be usually easily detached from a commodity, but is also requested to be easily detached from the commodity only by the person in charge. It is desirable that, for example, a work of detaching the buzzer tag from the commodity at the register upon payment for the commodity is performed as easily as possible.

In order to solve the problems, it is an object of the invention to provide an alarm tag releasing device by which the battery voltage of the buzzer tag can be easily confirmed at a proper time, thereby preventing battery exhaustion. The device can easily detach the buzzer tag from the commodity only by the person in charge, and can facilitate the detaching operation and maintenance of the buzzer tag which are necessary for operating a theft monitoring device using the buzzer tag.

SUMMARY OF THE INVENTION

According to a first aspect of the invention, there is provided an alarm tag releasing device used for a theft monitoring device comprising: a gate which is installed in a desired position and sets a theft monitoring region of a predetermined range by transmitting radio waves at a predetermined wavelength; and a buzzer tag which is attached to a commodity so as not to be detached by a built-in lock mechanism and has an alarm circuit operated by a built-in battery to sound an alarm on the basis of the received radio waves at the predetermined wavelength when the buzzer tag enters the monitoring region. In the alarm releasing device, an insertion part corresponding to the outer diameter of the buzzer tag and into which the buzzer tag can be inserted is formed. By inserting the buzzer tag into the insertion part, the lock mechanism built in the buzzer tag is unlocked.

According to a second aspect of the invention, there is provided an alarm tag releasing device in which the buzzer tag has a detection terminal for leading the battery voltage driving the built-in alarm circuit to the outside. The insertion part has a detection pin to be connected to the detection terminal and a voltage detecting circuit for detecting the voltage of the battery built in the buzzer tag via the detection pin. By inserting the buzzer tag into the insertion part, the buzzer tag is unlocked and the battery voltage is also detected.

According to a third aspect of the invention, an alarm tag releasing device in which the voltage detecting circuit sends a corresponding notifying signal when the battery voltage of the buzzer tag reaches a predetermined voltage or less.

According to a fourth aspect of the invention, an alarm tag releasing device is obtained in which the detection terminal of the buzzer tag is provided on the bottom of the buzzer tag, the detection pin is projected in a position facing the detection terminal on the bottom of the insertion part, and the detection terminal is connected to the detection pin by inserting the buzzer tag from above into the insertion part.

According to a fifth embodiment, there is provided an alarm tag releasing device in which the buzzer tag has a casing and a loop-shaped wire that is led from the casing and attached to a commodity. The lock mechanism comprises: a retaining member that is detachably provided for the casing and retains the loop-shaped wire in a state where the retaining member is pushed in the casing; and a lock member for locking the retaining member being pushed in the casing and is attracted and moved by a magnet so as to unlock the retaining member. The insertion part has the magnet at a position facing the lock member of the buzzer tag and the lock member is unlocked by insertion of the buzzer tag.

According to the first aspect of the invention, when the buzzer tag is attached to a commodity and the commodity is passed through the gate in such a state, the radio waves from the gate are received and an alarm is sounded from the alarm circuit of the buzzer tag.

The buzzer tag is detached from the commodity by using the alarm tag releasing device provided for a register or the like which is out of the monitoring region.

When the buzzer tag is inserted from above into the insertion part of the alarm tag releasing device, the lock mechanism is unlocked and the buzzer tag can be detached from the commodity.

According to the second aspect, when the buzzer tag is inserted into the insertion part, the detection terminal of the buzzer tag is connected to the detection pin, thereby detecting the voltage of the built-in battery by the voltage detecting circuit.

According to the third aspect, when the voltage of the battery is equal to or less than a predetermined voltage, the voltage detecting circuit notifies of the fact and demands battery change.

According to the fourth embodiment, the detection pin can be connected to the detection terminal only by inserting the buzzer tag from above into the insertion part and the attachment and detachment of the buzzer tag is facilitated.

According to the fifth embodiment, the loop-shaped wire can be unlocked only by inserting the buzzer tag from above into the insertion part.

As mentioned above, the buzzer tag is unlocked and the battery remaining amount is notified each time the buzzer tag is inserted into the insertion part of the alarm tag releasing device.

DETAILED DESCRIPTION OF THE PREFERRED EMBODIMENTS

Figure 1:
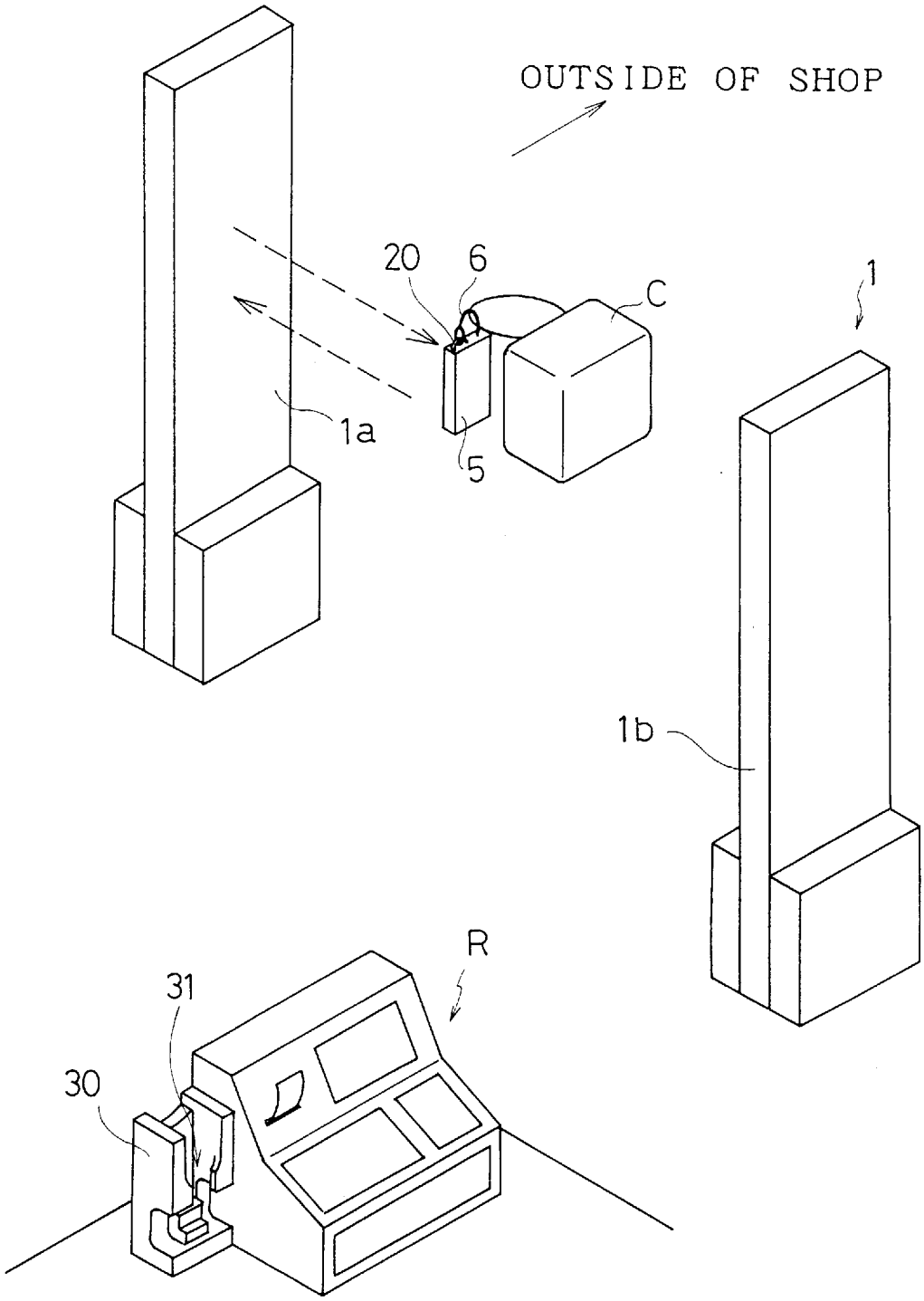
FIG. 1 is a diagram showing a construction of a whole theft monitoring device of the invention.

FIG. 1 is a diagram showing a construction of a whole theft monitoring device using an alarm tag releasing device of the invention.

A gate 1 having two facing parts is arranged at a doorway of a shop selling commodities. One part is a master gate antenna 1*a* and the other part is a servant gate antenna 1*b*.

Radio waves at a predetermined wavelength (for example, 32 kHz) are generated from the master gate antenna 1*a* and a region around the gate 1 is set as a monitoring region.

A monitored device (buzzer tag) 5 is attached to a commodity C. When the buzzer tag 5 enters the monitoring region, the buzzer tag 5 receives the radio waves from the master gate antenna 1*a* and sounds an alarm, thereby preventing the commodity C from being stolen.

When the buzzer tag 5 is detached from the commodity C at the time of the payment for the commodity, an alarm tag releasing device 30 is used.

The alarm tag releasing device 30 is attached to the side of a register R or the like. When the commodity C from which the buzzer tag 5 is detached by the alarm tag releasing device 30 is passed through the monitoring region of the gate 1, no alarm is sounded and the commodity C can be carried to the outside of the shop or the like.

The alarm tag releasing device 30 is provided out of the monitoring region in the shop for the gate 1. When the alarm tag releasing device 30 is attached to the side of the register R, the register R is installed in such a position.

Figure 2:
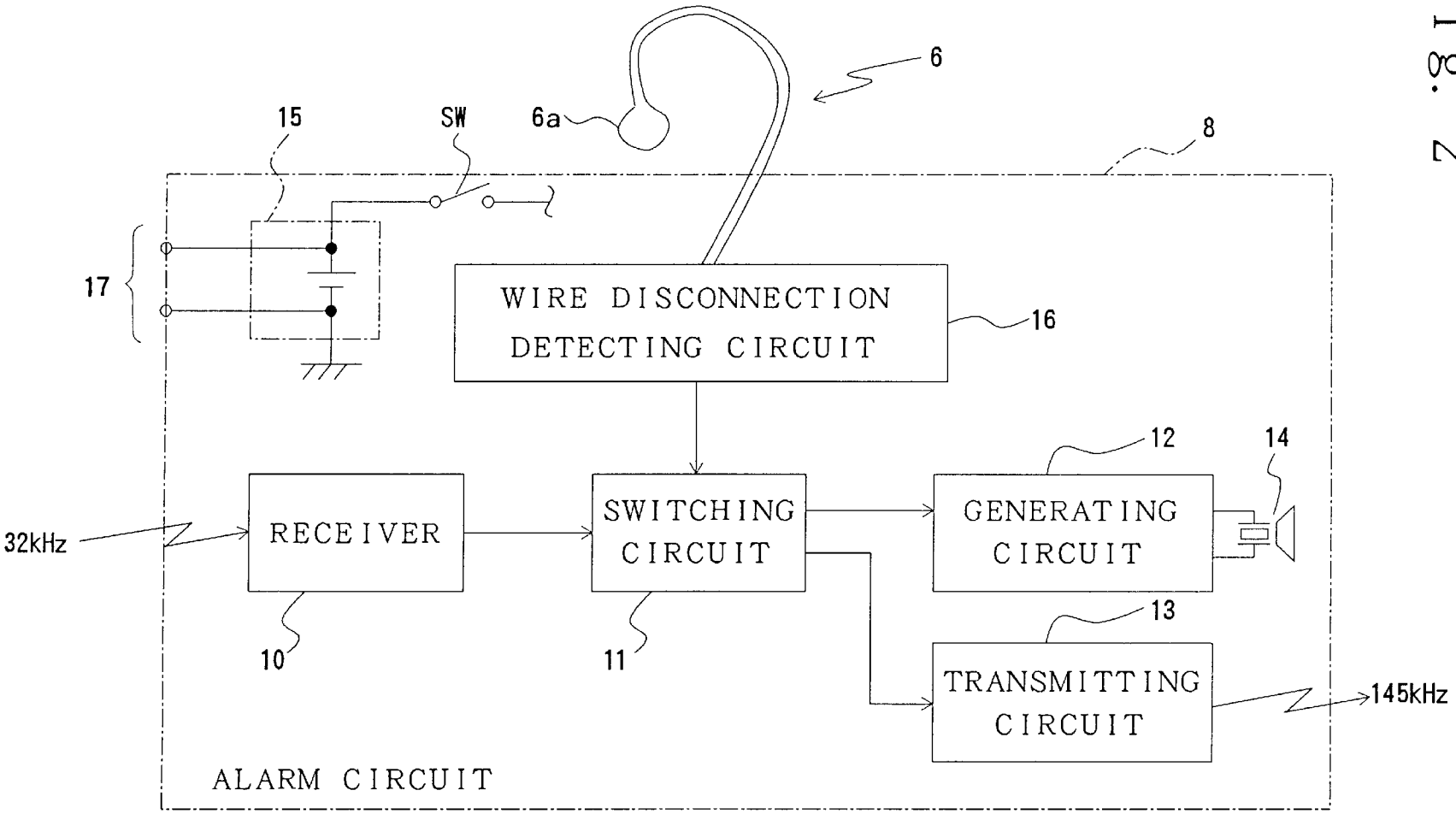
FIG. 2 is a block diagram showing circuits in a buzzer tag.

FIG. 2 is a block diagram showing an alarm circuit 8 provided in the buzzer tag 5.

The radio waves from the master gate antenna 1*a* are received by a receiver 10. The receiver 10 is connected to a switching circuit 11 and is operated upon receipt of the radio waves.

A generating circuit 12 and a transmitting circuit 13 are activated by the activation of the switching circuit 11. A buzzer 14 is sounded and the transmitting circuit 13 transmits radio waves at a predetermined wavelength (for example, 145 kHz).

It is sufficient that the wavelength of the radio waves generated by the master gate antenna 1*a* and the wavelength of the radio waves transmitted by the transmitting circuit 13 of the buzzer tag 5 are different and they can be arbitrarily set.

Both ends of a loop-shaped wire 6 are connected to a wire disconnection detecting circuit 16. The wire disconnection detecting circuit 16 activates the switching circuit 11 when the wire 6 is disconnected.

The alarm circuit 8 operates by using a battery 15 as a power source by a switch SW. Both ends of the battery 15 are connected to detection terminals 17 provided on the bottom 5*b* of the buzzer tag 5 and a voltage of the battery 15 is generated at the detection terminals 17.

A retaining loop 6*a* at the end of the loop-shaped wire 6 attached to the buzzer tag 5 is retained by a retaining member 20 of the buzzer tag 5 in a state where the wire 6 is attached to a part of the commodity.

When a person tries to carry out the commodity with the buzzer tag 5 to the outside and passes the monitoring region, the receiver 10 in the buzzer tag 5 receives the radio waves from the master gate antenna 1*a* and the buzzer 14 is sounded via the generating circuit 12.

Simultaneously, the transmitting circuit 13 transmits the radio waves at a predetermined wavelength. The radio waves are received by the receiving circuit of the master gate antenna 1*a* and the buzzer in the alarm part is sounded. Consequently, not only the buzzer tag 5 but also the gate 1 generate buzzer sounds to notify of the shoplifting.

When the wire 6 is disconnected in order to unjustly detach the buzzer tag 5 from the commodity, the wire disconnection detecting circuit 16 connected to the wire 6 detects the disconnection and generates a signal to the switching circuit 11. The switching circuit 11 operates the generating circuit 12 to sound the buzzer 14.

Figure 3:
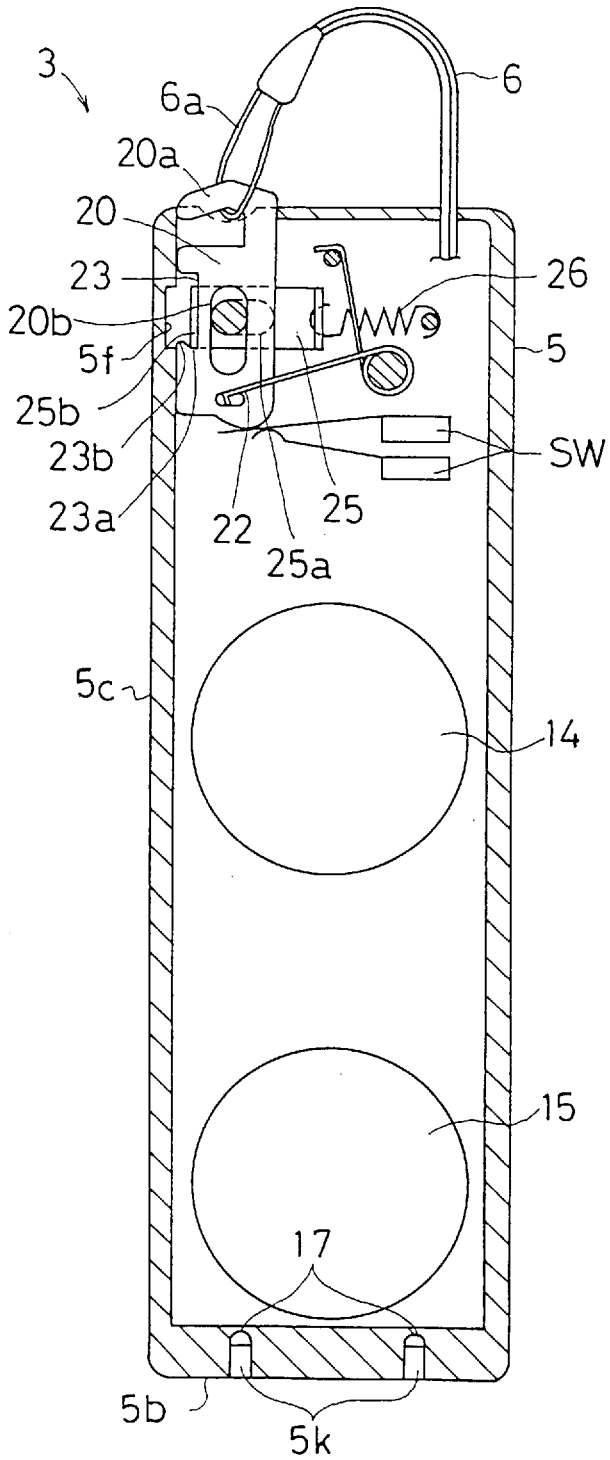
FIG. 3 is a cross section showing an internal construction of the buzzer tag.

FIG. 3 is a cross section showing the inner construction of the buzzer tag 5.

The wire 6 and a part of the retaining member 20 by which the retaining loop 6*a* is retained are exposed at the top of the buzzer tag 5.

A notched retaining part 20*a* by which the retaining loop 6*a* of the wire 6 is retained is formed in the upper part of the retaining member 20. A groove 5*a* (FIG. 6) in a V shape is formed in a position facing the notched retaining part 20*a* in the buzzer tag 5.

A hole 20*b* which is long in the vertical direction of the diagram is opened in the center of the retaining member 20 and into which a guide pin 21 is inserted. The retaining member 20 is always upwardly energized by a torsion coil spring 22.

A recessed part 23 like a notch is formed on a side (the periphery side of the buzzer tag 5) of the retaining member 20. A level difference part 23*a* is formed in the lower periphery of the recessed part 23 and a projection 23*b* is formed on the side of the level difference part 23*a*.

A lock member 25 can be engaged with the level difference part 23*a* of the retaining member 20.

The guide pin 21 is inserted into a long hole 25*a* in the lock member 25. The lock member 25 is movable in the lateral direction in the diagram. A predetermined tensile force is always applied to the lock member 25 so as to be apart from the periphery of the buzzer tag (toward the inside of the casing) by an extension coil spring 26.

An end of the lock member 25 is a lock piece 25*b* bent toward the recessed part 23 of the retaining member 20 and can be engaged with the level difference 23*a* of the retaining member 20 as shown in the diagram.

A notch 5*f* for release corresponding to the thickness of the lock piece 25*b* is formed like a groove on one side 5*c* of the buzzer tag 5 and on the inner face side positioning on the side of the lock member 25.

The lock member 25 is a magnetic plate (plate reacting to the magnetic force) and is obtained by, for example, folding an iron piece.

A lock mechanism 3 for holding (locking) the retained state of the wire 6 is substantially constructed by the retaining member 20 and the lock member 25.

Each of the retaining member 20 and the lock member 25 can slide in the above-mentioned direction by a guide piece (not shown).

The switch SW for operating/stopping the internal circuits interlockingly with the slide of the retaining member 20, the buzzer 14, and the battery 15 are housed in the buzzer tag 5.

Two insertion grooves 5*k* are opened at a predetermined pitch on the bottom 5*b* of the buzzer tag 5. The detection terminals 17 connected to both ends of the battery 15 are provided at the ends of the insertion grooves 5*k*.

Figure 4:
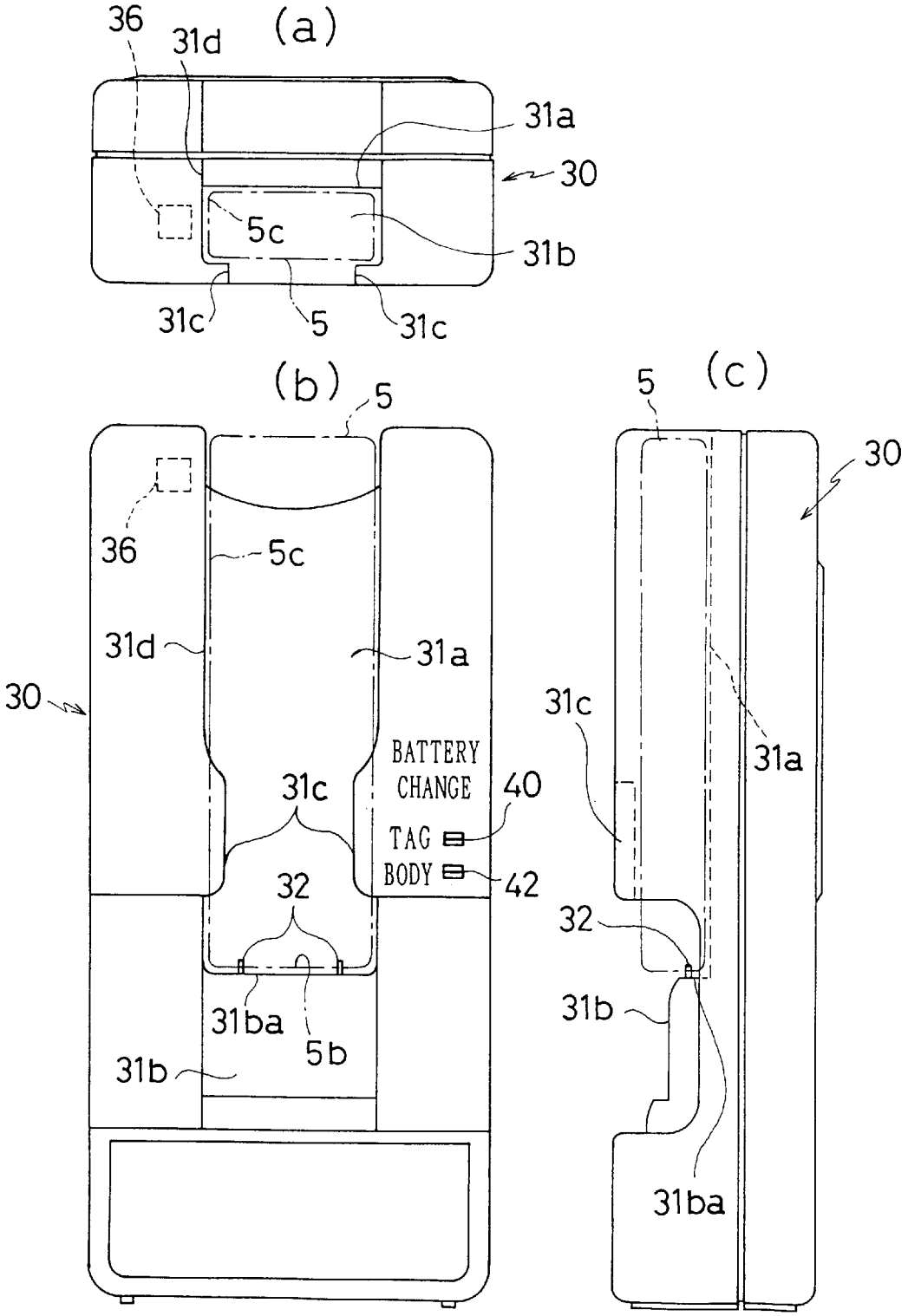
FIG. 4(A–C is) a top view, a front view, and a side view of an alarm tag releasing device, respectively.

FIGS. 4A, 4B, and 4C are a top view, a front view, and a side view of the alarm tag releasing device 30, respectively.

In the alarm tag releasing device 30, an insertion part 31 into which the buzzer tag 5 is inserted from above is opened in the center on the front side.

The insertion part 31 is formed in a groove shape corresponding to the outer diameter (width, height, depth) of the buzzer tag 5 and is constructed by a wall part 31*a* along the rear face of the buzzer tag 5, a level difference part 31*b* for positioning and holding the bottom 5*b* of the buzzer tag 5, and retaining projections 31*c* for holding the buzzer tag 5 in the insertion part 31.

Two detection pins 32 inserted into the insertion grooves 5*k* on the bottom 5*b* of the buzzer tag 5 and connected to the detection terminals 17 are projected from the top face 31*ba* of the level difference 31*b*.

When the buzzer tag 5 is inserted into a predetermined position of the insertion part 31 as shown in the diagram, the detection pins 32 are used to detect the voltage by a voltage detecting circuit 35 provided in the alarm tag releasing device 30.

A magnetic member 36 having a predetermined magnetic force is attached to a position corresponding to the lock member 25 when the buzzer tag 5 is inserted into the insertion part 31, on one side face 31*d* of the insertion part 31 of the alarm tag releasing device 30.

The magnetic member 36 generates a strong magnetic force so as to attract the lock piece 25*b* of the lock member 25 and is constructed by a magnet (or electromagnet) which has a magnetic force greater than the tensile force of the extension coil spring 26 and can move the lock member 25.

Figure 5:
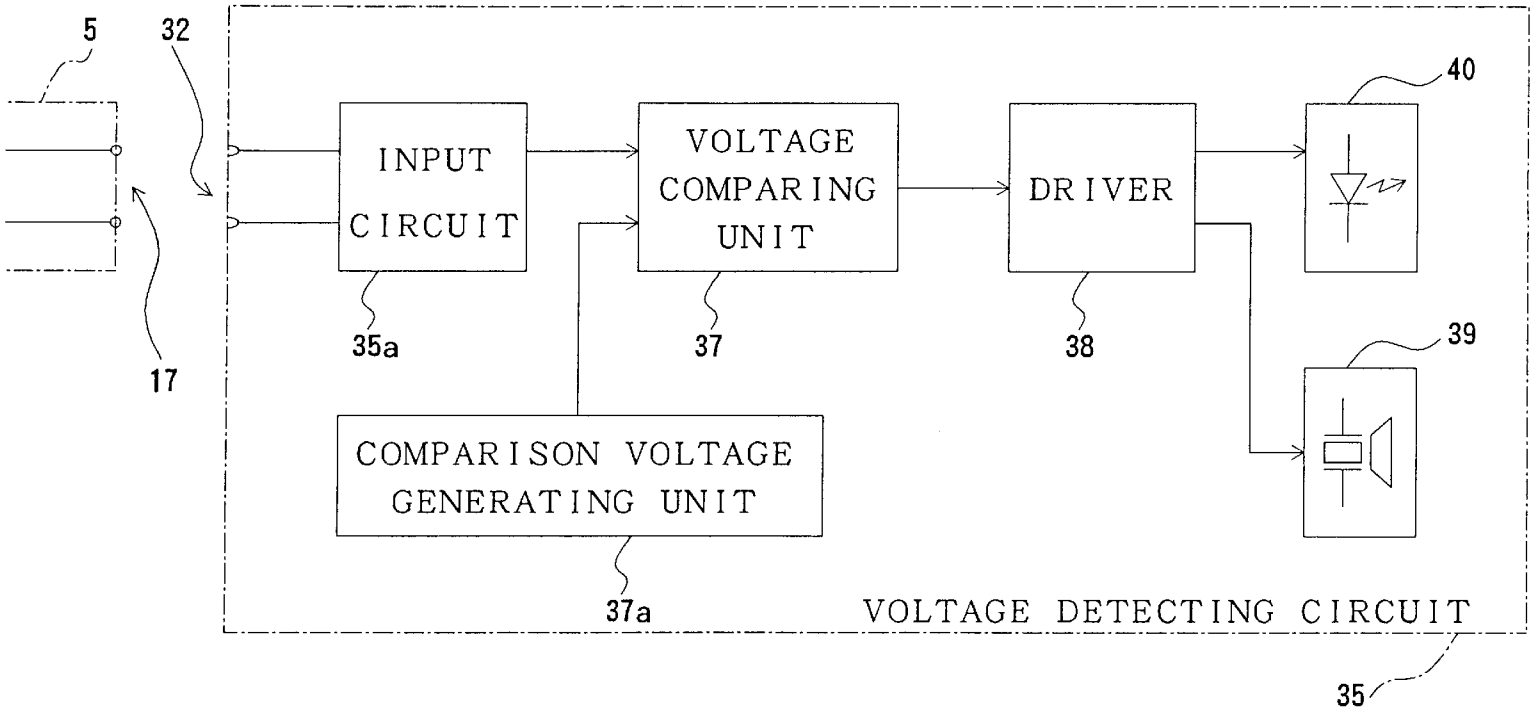
FIG. 5 is a diagram showing a construction of a voltage detecting circuit provided in the alarm tag releasing device.

FIG. 5 is a diagram showing a construction of the voltage detecting circuit 35.

The detection terminals 17 of the buzzer tag 5 are connected to the detection pins 32 of an input circuit 35*a* and an output of the input circuit 36 is supplied to a voltage comparing unit 37.

The voltage comparing unit 37 detects the voltage of the battery 15 built in the buzzer tag 5, compares the voltage with a set reference voltage value and sends the comparison result to a driver 41.

The reference voltage value is formed by a comparison voltage generating unit 38 and is set to a value which can operate the internal circuits of the buzzer tag 5. The reference voltage value of the comparison voltage generating unit 38 can be change to an arbitrary value by varying a resistance value or the like. It is desirable to set the reference voltage value slightly higher than the voltage value with which the alarm circuit 8 of the buzzer tag 5 can operate.

When a comparison result indicating that the voltage of the battery 15 of the buzzer tag 5 is higher than the reference voltage value is sent from the voltage comparison unit 37, the driver 41 generates a notification signal to a notifying unit 39 for a short time.

When a comparison result indicating that the voltage of the battery 15 of the buzzer tag 5 is lower than the reference voltage value is sent from the voltage comparison unit 37, a notification signal is intermittently generated to both of the notifying unit 39 and a light emitting unit 40.

The notifying unit 39 is constructed by a buzzer provide in the alarm tag releasing unit 30 and the light emitting unit 40 is constructed by a light emitting member such as an LED shown in FIG. 4B. The buzzer is intermittently sounded and the LED is intermittently blinked until the power source of the alarm tag releasing device 30 is turned off.

The voltage detecting circuit 35 is operated by the battery (for example, a dry cell) built in the alarm tag releasing device 30 or by rectifying a voltage of the AC power source.

In case of using the battery drive, the battery voltage is detected by a construction similar to the voltage detecting circuit 35. When a comparison result such that the voltage of the battery 15 built in the alarm tag releasing device 30 is lower than the reference voltage value, the light emitting unit 42 shown in FIG. 4B is intermittently blinked.

Since the voltage detecting circuit 35 of the alarm tag releasing device 30 is operated by a battery (for example, of 9 V) and the alarm circuit 8 of the buzzer tag 5 is operated by a small battery (for example, a lithium battery of 3 V), the input circuit 35*a* matches those different voltage values by a structure in which resistive potential division, variable resistance, and the like are combined.

An attaching operation of the buzzer tag 5 to the commodity will be described.

The buzzer tag 5 is attached to the commodity by passing the wire 6 part through a part of the commodity and retaining the wire 6 by the retaining member 20.

The retaining loop 6*a* of the wire 6 is retained by the notched retaining part 20*a* and the retaining member 20 is pushed down. The retaining member 20 is slid downwardly and the upper periphery of the notched retaining part 20*a* is inclined (opening formed by the notched retaining part 20*a* is narrow), so that the retaining loop 6*a* is naturally moved to the end (inner side) of the notched retaining part 20*a*. Consequently, the retaining loop 6*a* is not easily detached from the notched retaining part 20*a* and the retaining operation can be easily performed while moving the retaining member 20 downward.

By sliding the retaining member 20 downwardly, as shown in FIG. 3, the lower end of the retaining member 20 is come into contact with one of the switches SW, thereby electrically closing the switches SW. The alarm circuit 8 in the buzzer tag 5 is consequently operated and the monitoring operation or the like at the gate 1 is started.

When the retaining member 20 is moved and the recessed part 23 is slid to a position of the lock member 25, the lock member 25 slides by the tensile force of the extension coil spring 26 and the lock piece 25*b* is fit into the recessed part 23.

After that, when pushing down of the retaining member 20 is stopped, the retaining member 20 is slightly moved upward by the spring force of the torsion coil spring 22. The lock piece 25*b* is consequently retained at the position of the level difference 23*a* as shown in the diagram and the locked state is maintained by the projection 23*b*.

When the buzzer tag 5 is attached to the commodity, the retaining loop 6*a* of the wire 6 is retained by the notched retaining part 20*a* and is pushed to the inside of the buzzer tag 5, and the upper part of the notched retaining part 2O*a* of the retaining member 20 is suppressed to an extent slightly exposed in the V-shaped groove 5*a*.

Since the upper part of the retaining member 20 is not easily cut, the wire 6 is not therefore easily detached from the notched. retaining part 20*a*.

The tag releasing operation of the alarm tag releasing device 30 will be described.

A case where the alarm tag releasing device 30 is provided near the register R as shown in FIG. 1 will be described. The commodity C with the buzzer tag 5 attached is carried by a customer or the like who wants to buy it to the register.

The person in charge of the register inserts the buzzer tag 5 from above to the insertion part 31 of the alarm tag releasing device 30 in a state where the buzzer tag 5 is attached to the commodity C.

The lock member 25 of the buzzer tag 5 is positioned to the position of the magnetic member 36 in the alarm tag releasing device 30 shown in FIG. 2 and the magnetic member 36 attracts the lock piece 25*b* of the lock member 25.

Since the lock piece 25*b* in this instance is retained by the projection 23*b* of the retaining member 20 as shown in FIG. 3, the lock piece 25*b* cannot be immediately moved toward the magnetic member 36.

However, when the retaining member 20 is slightly moved downward by a manual operation in such a state, the projection 23*b* is moved below the lock piece 25*b* and the lock member 25 is moved toward the magnetic member 36.

Figure 6:
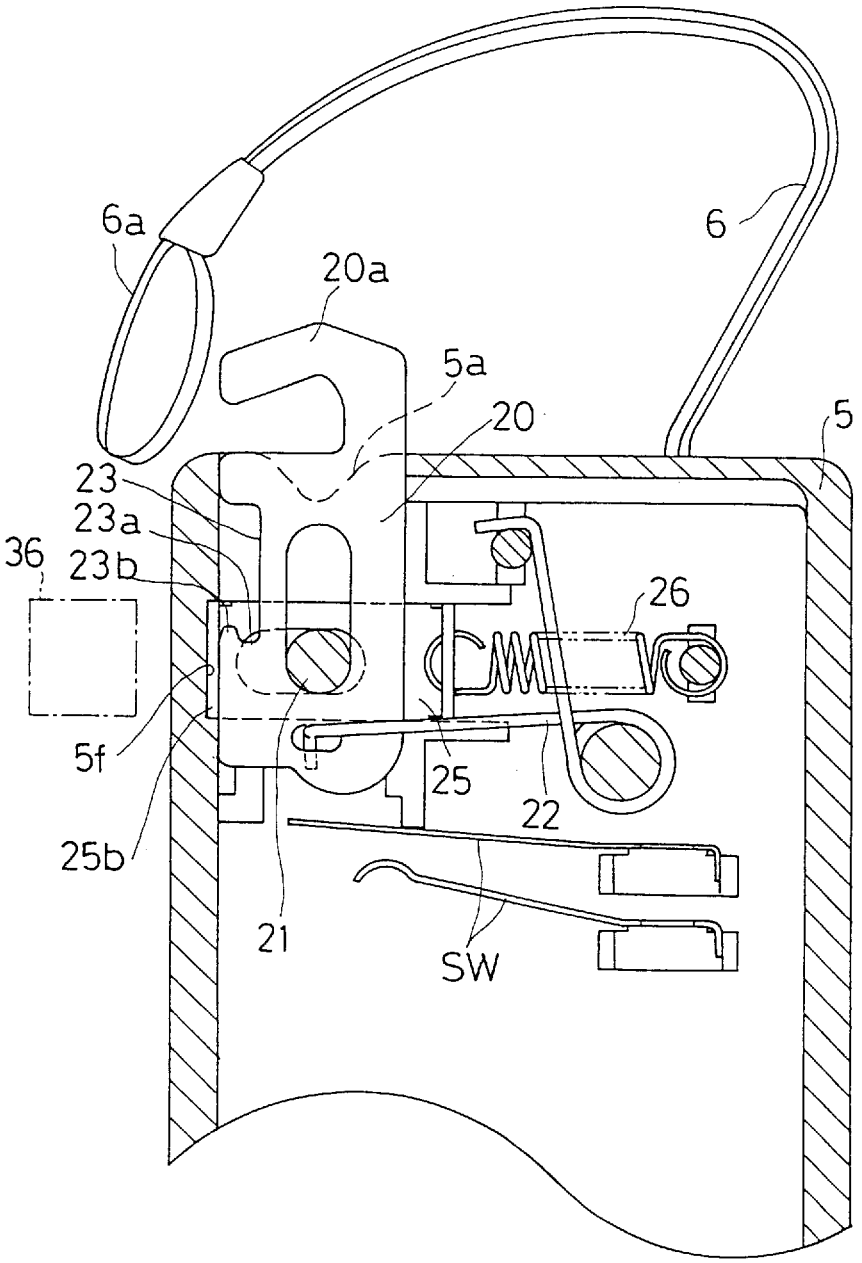
FIG. 6 is an enlarged cross section showing a released state of the buzzer tag.

FIG. 6 is a partial cross section showing a state where the buzzer tag 5 is released. As shown in the diagram, when the lock member 25 is moved to the notch 5*f* of the buzzer tag 5, the retaining member 20 is moved upward by the torsion coil spring 22.

Thus, the retaining loop 6*a* of the wire 6 can be taken off from the notched retaining part 20*a* in the upper part of the retaining member 20 and the buzzer tag 5 can be detached from the commodity C.

Simultaneously, the switches SW are opened and the buzzer 14 does not sound an alarm even if the buzzer tag 5 in which the wire is released enters the monitoring region.

When the buzzer tag 5 is inserted from above into the insertion part 31 of the alarm tag releasing device 30 as mentioned above, the detection terminals 17 on the bottom 5*b* of the buzzer tag 5 are simultaneously connected to the detection pins 32 of the voltage detecting circuit 35, so that the voltage of the battery 15 in the buzzer tag 5 can be detected.

When it is discriminated by the comparison result of the voltage comparing unit 37 that the detected voltage value of the battery 15 is equal to or larger than the reference voltage value, the buzzer of the informing unit 39 is sounded for a very short time, thereby informing that the voltage is normal.

However, when the detected voltage value of the battery 15 is lower than the reference voltage value, the buzzer of the informing unit 39 is intermittently sounded, thereby informing that the voltage is low. Simultaneously, an LED of the light emitting unit 40 is blinked.

As mentioned above, the remaining amount of the battery can be checked simultaneously with the release of the tag only by inserting the buzzer tag 5 from above into the insertion part 31 of the alarm tag releasing device 30. This can be done by only one hand. Only person in charge of the monitoring device for operating the alarm tag releasing device 30 can easily perform the releasing operation and the check of the voltage.

Since the insertion part 31 of the alarm tag releasing device 30 is opened except of the retaining projections 31*c*, the inserting state of the buzzer tag 5 can be easily confirmed from the front and the buzzer tag 5 can be easily inserted and detached.

The buzzer tag 5 can be released by a simple operation of merely pushing the retaining member 20 which is inserted into the insertion part 31.

The remaining amount of the battery is also checked each time the tag is released, so that the operation is facilitated and the occurrence of the battery exhaustion of the buzzer tag 5 can be prevented.

Especially, when there are a number of commodities and also a number of buzzer tags 5 correspondingly, by using the alarm tag releasing device 30, the battery state can be checked as well as the release of each buzzer tag 5. Every buzzer tag 5 can be consequently used under the same condition without battery exhaustion.

Although the case where the alarm tag releasing device 30 is provided near the register R and the tag is released and subjected to the battery voltage check by the alarm tag releasing device 30 at the time of the payment for the commodity C has been described, not only at the time of payment for the commodity C, the alarm tag releasing device 30 can be also used according to the convenience of the user of the device in other occasions such as inventory and the like when the tag is released from the commodity C.

The alarm tag releasing device of the invention has a construction such that the insertion part corresponding to the outer diameter of the buzzer tag is provided and the buzzer tag is inserted into the insertion part, thereby unlocking the lock mechanism. The buzzer tag can be easily detached from the commodity by only one hand without troubles. Even if the releasing device is attached to the register which is used for receiving the payment for the commodity, or the like, the casher's work can be smoothly performed. The buzzer tag can be easily detached from the commodity only by the person in charge of the alarm tag releasing device.

The detection terminals of the battery of the buzzer tag are introduced to the outside, the detection pins which can be connected to the detection terminals are provided in the insertion part of the alarm tag releasing unit and the voltage of the battery is detected by the voltage detecting circuit. With such a construction, only by inserting the buzzer tag into the alarm tag releasing device, the voltage of the battery in the buzzer tag can be checked as well as the unlocking operation and the voltage exhaustion can be prevented. Especially, when there are a number of buzzer tags, the battery of each tag can be checked each time the buzzer tag is detached from the commodity at the time of payment for the commodity or the like without checking the battery of each buzzer tag. Thus, the voltage of the battery can be confirmed daily.

If it is constructed in such a manner that a corresponding notification signal is sent when the voltage of the battery of the buzzer tag becomes equal to or less than a predetermined voltage, the buzzer tag whose battery has to be changed can be easily grasped and the management of the battery in the buzzer tag can be facilitated.

Further, with a simple construction such that the detection terminals are provided on the bottom of the buzzer tag and the detection pins are provided in the insertion part of the alarm tag releasing device so as to face the detection terminals, only by inserting the buzzer tag from above into the insertion part, the voltage can be checked.

What is claimed is:

1. An alarm tag releasing device for a theft monitoring system, said theft monitoring system having a gate installed in a desired position and producing a theft monitoring region having a predetermined range by transmitting radio waves at a predetermined wavelength, and a buzzer tag attached to a protected item by a built-in lock mechanism so as to be securely connected to the protected item, said buzzer tag having an alarm circuit operated by a built-in battery to sound an alarm when the radio waves at the predetermined wavelength are received when the buzzer tag enters the monitoring region, said alarm tag releasing device comprising:

an insertion part, said insertion part having a shape corresponding to an outer diameter of the buzzer tag, said insertion part being configured such that the buzzer tag can be inserted therein so that the lock mechanism provided in the buzzer tag is released when the buzzer tag is inserted into the insertion part.

2. The alarm tag releasing device according to claim 1, wherein the buzzer tag has a detection terminal for providing the voltage of the battery driving the built-in alarm circuit to the outside, and wherein the insertion part has a detection pin to be connected to the detection terminal and a voltage detecting circuit for detecting the voltage of the battery built into the buzzer tag via the detection pin, and the buzzer tag is unlocked and also the voltage of the battery is detected by the insertion of the buzzer tag into the insertion part.

3. The alarm tag releasing device according to claim 2, wherein, when the voltage of the battery in the buzzer tag is equal to or lower than a predetermined voltage, the voltage detecting circuit sends a corresponding notification signal.

4. The alarm tag releasing device according to claim 2, wherein the detection terminal is provided on the bottom of the buzzer tag, the detection pin is projected into a position facing the detection terminal on the bottom of the insertion part, and the detection terminal is connected to the detection pin by the insertion of the buzzer tag from above into the insertion part.

5. The alarm tag releasing device according to claim 1, wherein the buzzer tag has a casing and a loop-shaped wire that is led from the casing and is attached to the protected item, the lock mechanism comprises a retaining member which is detachably provided for the casing and retains the loop-shaped wire when the retaining member is pushed into the casing, and a lock member that locks the retaining member into the casing and is attracted and moved by a magnet so as to unlock the retaining member, and the insertion part has the magnet in a position facing the lock member of the buzzer tag and the lock member is unlocked by insertion of the buzzer tag.

* * * * *

UNITED STATES PATENT AND TRADEMARK OFFICE

CERTIFICATE OF CORRECTION

PATENT NO. : 5,864,290

DATED : January 26, 1999

INVENTOR(S) : Toyomi et al.

It is certified that error appears in the above-identified patent and that said Letters Patent is hereby corrected as shown below:

Column 6, line 13, delete "36", and insert therefor -- 35a --

Column 6, line 18, delete "41", and insert therefor -- 38 --

Column 6, line 20, delete "38", and insert therefor -- 37a --

Column 6, line 23, delete "38", and insert therefor -- 37a --

Signed and Sealed this

Thirtieth Day of May, 2000

*Attest:*

*Attesting Officer*

Q. TODD DICKINSON

*Director of Patents and Trademarks*